United States Patent [19]

Jones et al.

[11] 4,152,015

[45] May 1, 1979

[54] CASING HANGER

[75] Inventors: Marvin R. Jones; Paul E. Helfer; John H. Cohen, all of Houston, Tex.

[73] Assignee: Cameron Iron Works, Inc., Houston, Tex.

[21] Appl. No.: 808,682

[22] Filed: Jun. 21, 1977

[51] Int. Cl.[2] ..... E21B 19/10; A44G 21/00

[52] U.S. Cl. ..... 285/146; 24/263 DT; 24/263 D

[58] Field of Search ..... 24/263 DT, 263 D, 263 DA, 24/263 DC; 285/141, 146, 147

[56] References Cited

U.S. PATENT DOCUMENTS

| | | | |
|---|---|---|---|
| 1,560,701 | 11/1925 | Layton | 24/263 DT |
| 1,908,652 | 5/1933 | Adair | 24/263 DT |
| 2,071,637 | 2/1937 | Laurent | 24/263 DT |
| 2,134,468 | 10/1938 | Bashara | 24/263 DT |
| 2,676,036 | 4/1954 | Arrowood | 24/263 D |
| 2,785,454 | 3/1957 | Young | 24/263 DT |
| 3,531,836 | 10/1970 | Crickmer | 24/263 D |

*Primary Examiner*—Bernard A. Gelak
*Attorney, Agent, or Firm*—Vinson & Elkins

[57] ABSTRACT

A casing hanger for supporting a casing from a casing head within a well bore having a split ring with sealing means attached thereto, a plurality of gripping assemblies supported from the split ring and each of said assemblies including a body with an inwardly facing recess and an exterior surface which tapers downward and inward, to seat in the casing head bowl a plurality of gripping dogs having a generally horizontal gripping edge extending radially inward from the body, and a deformable backing positioned within the space between the outer edge of said dogs and the body recess, the backing partially filling the space behind the dogs and having space into which the backing may move on deformation, the backing providing varying areas in support of each gripping dog and being relatively yieldable.

7 Claims, 3 Drawing Figures

CASING HANGER

BACKGROUND OF THE INVENTION

Casing hangers are used to support casing from a casing head in a well bore. One disadvantage of prior casing hangers has been that they often exert the greatest force in the area of the pipe which is subjected to the greatest stress. The prior patent to Marvin R. Jones, U.S. Pat. No. 3,052,943, provided flexible gripping elements backed by a confined deformable part which acts as a quasi-liquid to transmit the gripping load from teeth nearest the load application to the teeth away from the load application. This structure tends to uniformly load the gripping elements.

Another type of gripping assembly has used individual pipe engaging elements or dogs which are held in a stack in a dove-tailed groove with an alloy steel backing plate behind the dogs. The knurled top half of the front edge of each dog contacts the pipe and the bottom half is beveled away to allow clearance when the dog is rolled upward. The top half of the back edge of each dog is relieved by rounding to permit the dog to roll upward and away from the pipe when the pipe is raised to facilitate release of the engagement of the dogs with the pipe. Such rolling dog type of gripping assembly does not include a variable area deformable backing in support of the gripping elements.

SUMMARY

The present invention provides an improved casing hanger in which the gripping assemblies engaging the casing being supported include a deformable backing having a variable area in support of the gripping dogs and a space for deformation without transmitting the forces causing the deformation through the backing to the other gripping dogs.

An object of the present invention is to provide an improved casing hanger having a lower radial gripping force on the supported member in the area of its highest axial stress whereby substantially full strength of the casing may be utilized.

Another object is to provide an improved casing hanger which avoids excessive stresses in the gripping teeth and in the casing being gripped thereby.

Still another object is to provide an improved casing hanger having a minimum radial thickness and without excessive stresses on the gripping edges of the dogs and along the gripped portion of the casing.

A still further object is to provide an improved casing hanger which will accommodate uneven surfaces on the exterior portion of the casing being supported.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENTS

Figure 1:
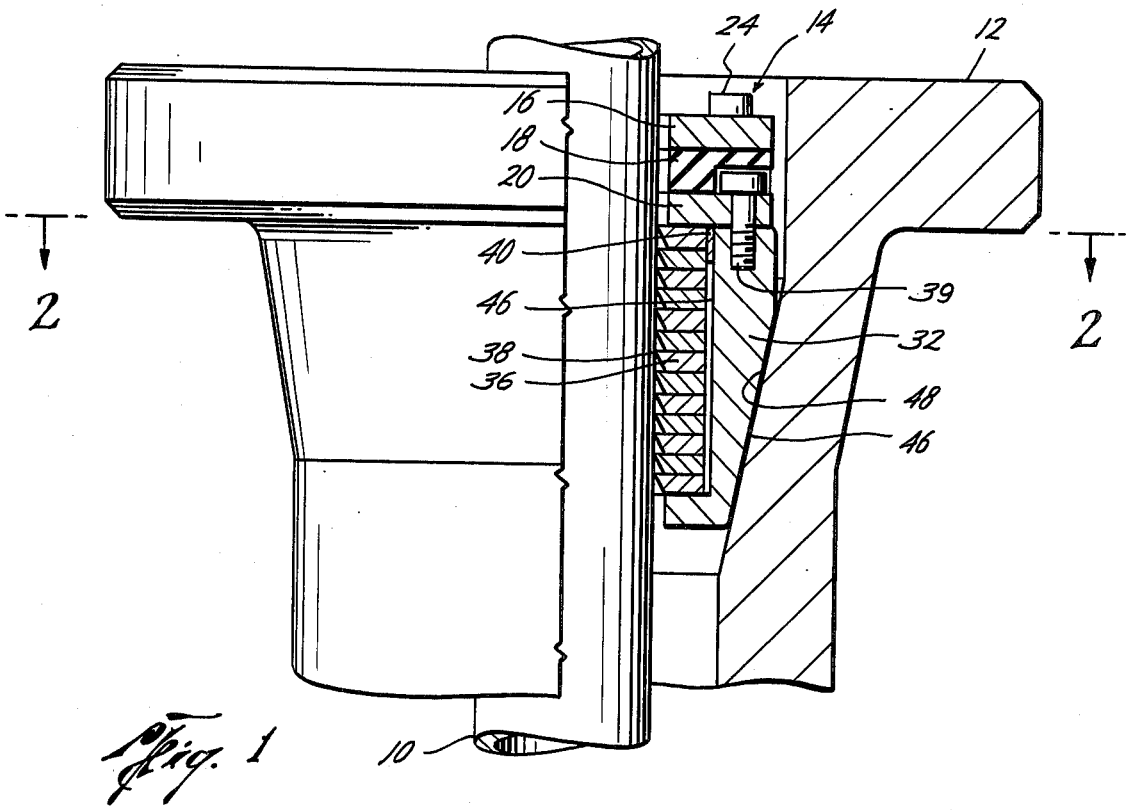
FIG. 1 is an elevation view, partly in section of the preferred form of casing hanger of the present invention showing the casing hanger in operative position between a casing head and a casing.
Figure 2:
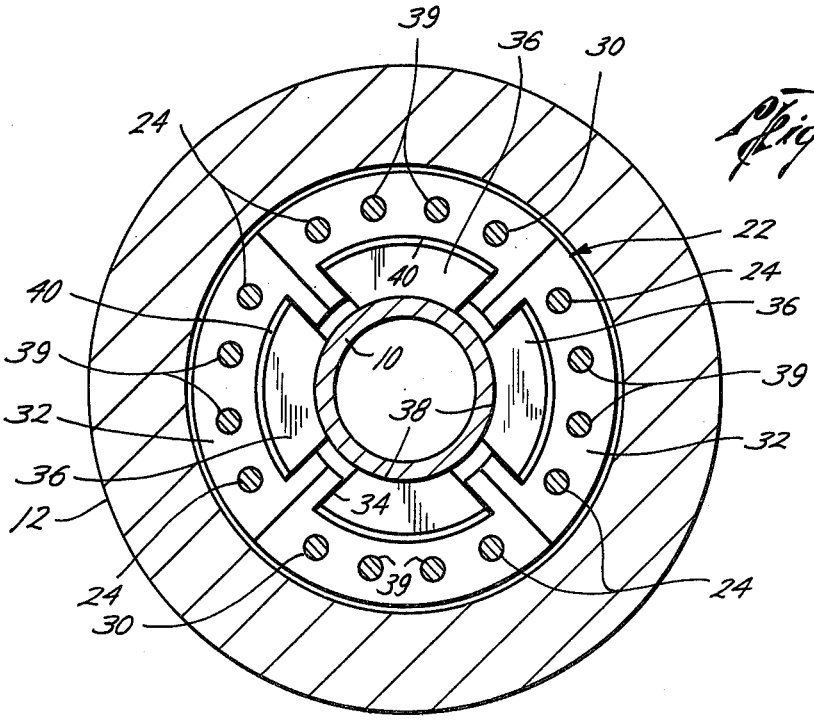
FIG. 2 is a sectional view taken along lines 2—2 in FIG. 1.
Figure 3:
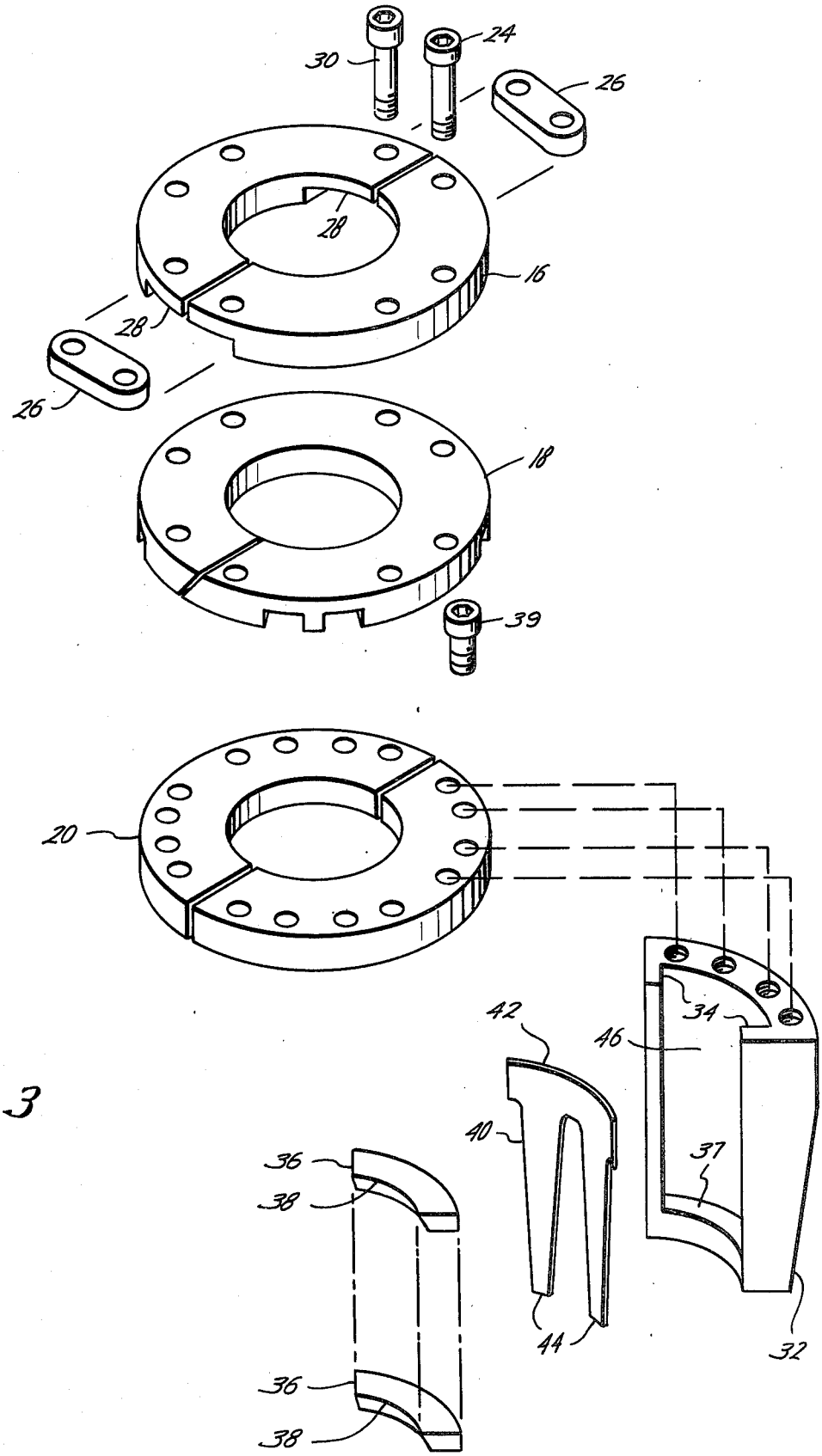
FIG. 3 is an exploded view of a portion of the casing hanger of the present invention.

In the preferred form of the invention the casing 10 is supported against downward movement with respect to the casing head 12 by the casing hanger 14. The casing hanger 14 includes the split seal actuating ring 16, the split sealing ring 18, the split retaining ring 20 and a plurality of gripping assemblies 22 supported from the ring 16 by the cap screws 24. Casing hanger 14 is similar to the H. Allen et al U.S. Pat. No. 3,011,806 structure in that it is adapted to be opened by disconnecting the links 26 which are positioned in the recesses 28 in the under side of ring 16 and secured to ring 16 by the cap screws 24 and 30. With the cap screws 30 removed, the ring 16 is free to open and be placed around a casing as shown in FIG. 9 of the aforementioned H. Allen et al patent. Thereafter, the links 26 are secured in place to form a ring around the casing being supported. As shown in FIG. 2 herein, four gripping assemblies 22 are provided, however, smaller casing may dictate fewer gripping assemblies be included and larger casing may dictate that a greater number of gripping assemblies be used. For clarity, only one of the gripping assemblies 22 is shown in FIG. 3.

The gripping assemblies 22 each include a body 32 having an inward facing recess 34 in which a plurality of gripping dogs 36 are partially positioned with their generally horizontal gripping edges 38 extending inwardly from the body 32 for engagement with the casing 10 and a deformable backing 40 positioned in the recess 34 behind the dogs 36. The recess 34 has a dovetail shape as seen in FIG. 3, to retain the dogs 32 therein and the lower dog 32 rests on the shoulder 37 or bottom of the recess 34. The ring 20 retains the dogs 36 in the recess and is secured to the body 32 by the cap screws 24 and the cap screw 39.

The backing 40 is of a material which is relatively yieldable and which is not hardened by strain. Further, such material should not be subject to any appreciable amount of creep. The deformable backing 40 has a preferred shape as shown in FIG. 3 with a solid top 42 portion and two depending legs 44 which decrease in area in the downward direction. This shape provides open spaces between the backs of the dogs 36 and the inner surface 46 of the recess 34 into which the material of backing 40 may move on deformation without transmitting the force causing its deformation to the other dogs 36. With the smallest area of backing 40 behind the lowest of the dogs 36, the lowest dog moves inward at a lower force when its backing deforms than the dogs above it. Thus, the backing by having variable area provides for lower engaging forces by the lower dogs when the casing hanger approaches full loading. This distributes the stresses in the engaged portion of the casing to provide an improved casing hanger.

The lower exterior of body 32 is provided with a tapered seating surface 48 for seating in the inner bowl surface 50 of the casing head 12.

From the foregoing it can be seen that the improved casing hanger of the present invention limits the force exerted by the engaging edge of the gripping dogs to provide lower gripping forces on the supported member in the area of its highest stresses. Also, this improved structure easily accommodates uneven surfaces on the supported member and has a minimum of radial thickness.

What is claimed is:

1. A casing hanger for supporting a tubular member in a casing head, comprising a split ring adapted to be opened and closed about said tubular member, split sealing means attached to said ring, a plurality of gripping assemblies supported by said ring, each including a body having an inwardly facing recess and an outwardly facing tapered surface, gripping means positioned at least partially within said recess, said gripping means including a plurality of gripping elements, means for retaining said gripping means, and a deformable backing in said recess between said gripping means and said body, said backing being shaped to provide larger backing area for some of said gripping elements than for others of said gripping elements, said backing having a smaller volume than the space in said recess behind said gripping elements to allow space into which said backing may move on deformation thereof.

2. A casing hanger according to claim 1, wherein said gripping means includes dogs having arcuate generally horizontal gripping edges extending inwardly beyond said body when the dogs are positioned therein.

3. A casing hanger according to claim 2, wherein said backing is shaped to provide smaller backing areas to the lower dogs than the upper dogs.

4. A casing hanger according to claim 1, wherein said backing is relatively yieldable and not strain-hardenable.

5. A casing hanger for supporting a tubular member in a casing head, comprising a split ring adapted to be opened and closed about said tubular member, split sealing means attached to said ring, a plurality of gripping assemblies supported by said ring, each including a body having an inwardly facing recess and an outwardly facing tapered surface, gripping means positioned at least partially within said recess, means for retaining said gripping means, and a deformable backing in said recess between said gripping means and said body, said backing being shaped to provide varied backing area for said gripping means and to allow space into which said backing may move on deformation thereof, said backing having a solid upper portion with two legs depending therefrom and each leg is reduced in area in the downward direction in support of said gripping means.

6. For use in a casing hanger a gripping assembly comprising a body having an inwardly facing recess and an outwardly facing tapered surface, gripping means positioned at least partially within said recess, said gripping means including a plurality of gripping elements, means for retaining said gripping means, and a deformable backing in said recess between said gripping means and said body, said backing being shaped to provide larger backing area for some of said gripping elements than for others of said gripping elements, said backing having a smaller volume than the space in said recess behind said gripping elements to allow space into which said backing may move on deformation thereof.

7. A casing hanger for supporting a tubular member in a casing head, comprising a split ring adapted to be opened and closed about said tubular member, split sealing means attached to said ring, a plurality of gripping assemblies supported by said ring, each including a body having an inwardly facing recess and an outwardly facing tapered surface, gripping means positioned at least partially within said recess, said gripping means including a plurality of gripping elements, means for retaining said gripping means, and a deformable backing in said recess between said gripping means and said body, said backing having a smaller volume than the space in said recess behind said gripping elements to allow space into which said backing may move on deformation thereof, said backing being shaped so that the width of said backing decreases in a downward direction whereby said backing presents different backing support for at least some of said gripping elements.

* * * * *